US006004118A

United States Patent [19]

Templar

[11] Patent Number: 6,004,118

[45] Date of Patent: Dec. 21, 1999

[54] VALVE POLARIZATION MEANS, FOR A FLUID-WORKING MACHINE STRUCTURE

[75] Inventor: Gary A. Templar, Beaver Dams, N.Y.

[73] Assignee: Dresser-Rand Company, Corning, N.Y.

[21] Appl. No.: 09/036,605

[22] Filed: Mar. 6, 1998

[51] Int. Cl.[6] ..... F04B 39/14; F16K 43/00

[52] U.S. Cl. ..... 417/571; 417/454; 137/315; 251/367

[58] Field of Search ..... 417/571, 454; 137/315, 565.01; 251/367

[56] References Cited

U.S. PATENT DOCUMENTS 4,607,660 8/1986 Bennitt ..... 137/512.1

*Primary Examiner*—Tony M. Argenbright
*Assistant Examiner*—Arnold Castro
*Attorney, Agent, or Firm*—Bernard J. Murphy

[57] ABSTRACT

Inlet valves, with inlet cages, in inlet ports in a cylinder head, and outlet valves, with outlet cages, in outlet ports in the cylinder head, comprise mating combinations of elements which exhibit optimum and proper seating together. The bores and the cages have configurations which, upon elements of one of the combinations being substituted for elements of the other combination, will prevent the seatings from occurring. Consequently, only the correct elements, per combination, will join together and nest in the correct bore and, in this way, the seating of an inlet valve in an outlet bore, or vice versa, is avoided.

9 Claims, 2 Drawing Sheets

FIG. 1
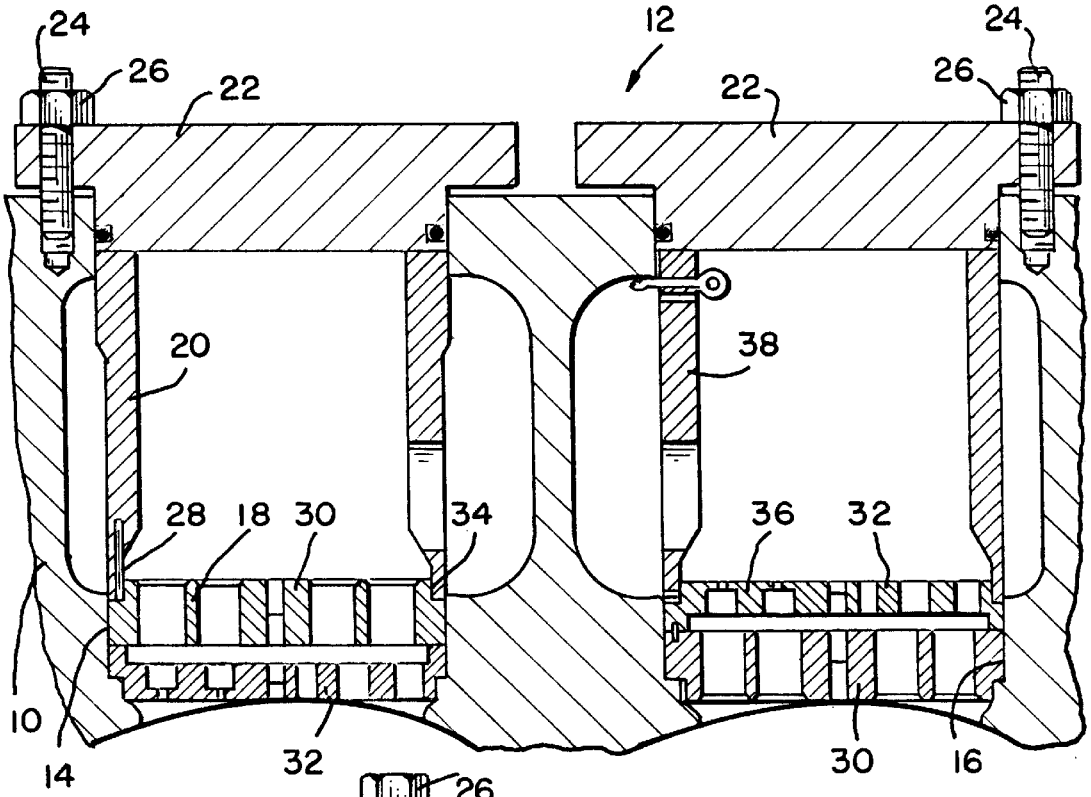
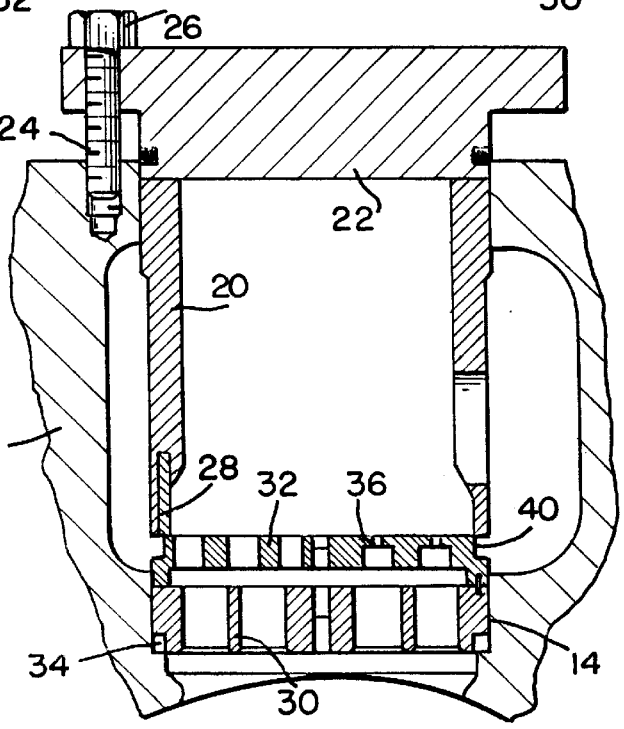
FIG. 2

VALVE POLARIZATION MEANS, FOR A FLUID-WORKING MACHINE STRUCTURE

This invention pertains to polarization, that is, the proper, optimum fitting of only correct fluid-control valves in the relevant structure of a fluid-working machine, such as a gas compressor or such. Gas compressors have gas inlet ports and gas outlet ports, and complementary fluid inlet valves, and fluid outlet valves for emplacement in the respective ports or valve bores of the gas compressor structure. If, by chance a fluid inlet valve were to be installed in the discharge port or bore of a gas compressor, a dangerous over pressurization of the machine could result. Consequently, it is imperative that there obtains an efficient and sure means for polarizing the positioning of fluid valves in gas compressors, gas expanders, and the like.

Other than polarizing the very valves themselves, there has been no alternative and novel means of so configuring the valve-receiving bores, and the valve-engaging cages, to insure that only an inlet valve with an inlet-valve cage will be fully receivable in an inlet bore, and conversely, that only an outlet valve, with an outlet-valve cage will be fully receivable in an outlet valve bore.

It is an object of this invention, then, to set forth just such an alternative means as defined above. Specifically, it is an object of this invention to disclose valve polarization means, for a fluid-working machine structure, comprising first means defining a cylinder head with valve-receiving bores formed therein; fluid control valves; and second means defining cages for said valves; wherein a given one of said valves, a given one of said cages, and a given one of said bores, together, comprise a first, mating combination of elements which exhibits a first, optimum and proper seating together of said one valve and said one cage with, and within, said one bore; another of said valves, another of said cages, and another of said bores, together, comprise a second, mating combination of elements which exhibits a second, optimum and proper seating together of said other valve and said other cage with and within, said other bore; and at least one of said first and second means comprises a configuration which, upon a substitution of one of said elements of one of said first and second mating combinations with a complementary one of said elements of the other of said first and second mating combinations, that is: said given valve for said other valve, and vice versa, said given cage for said other cage and vice versa, and said given bore for said other bore, and vice versa, comprises means for preventing one of said first and second seatings to occur.

Further objects of this invention, as well as the novel features thereof will become apparent by reference to the following description, taken in conjunction with the accompanying figures, in which:

FIG. 1 is a vertical cross-section of a portion of a cylinder head in a gas compressor, the same depicting, in juxtaposition, inlet and outlet bores, inlet and outlet valves and valve cages for each of said valves;

FIG. 2 shows an inlet bore, and an inlet cage, with a mis-mating outlet valve, and a portion of a cylinder head, all being cross-sectioned;

Figure 3:
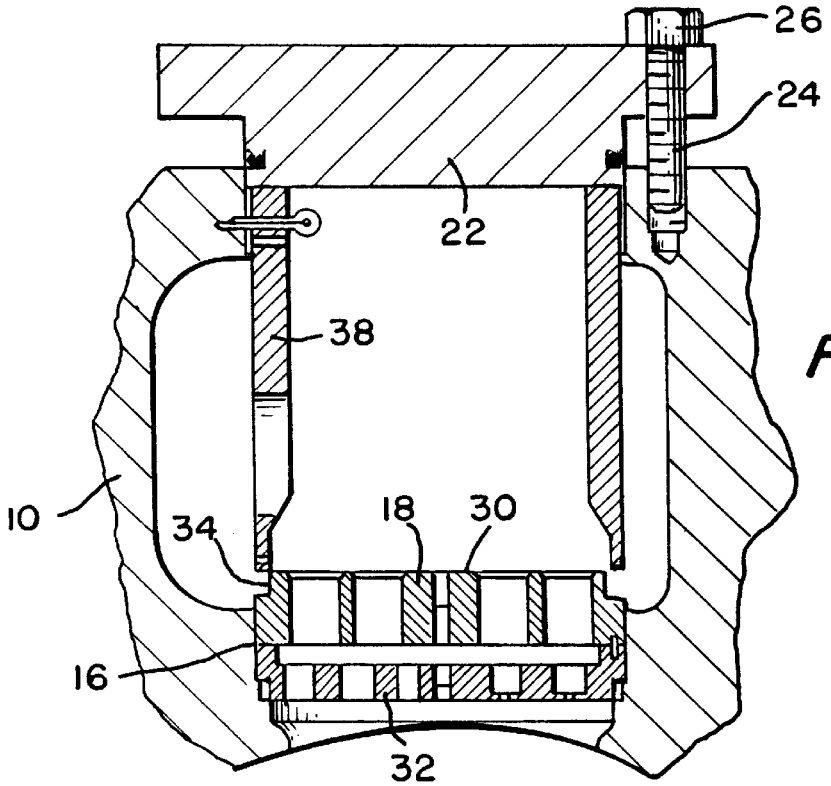
FIG. 3 depicts a discharge bore, and a discharge cage, with a mis-mating inlet valve, all said components being vertically cross-sectioned.

With reference to FIG. 1, the portion 10 of a cylinder head shown therein comprises a structural part of a gas compressor 12 which, for exemplary purposes, is the end item or machine in which the invention is incorporated. The cylinder head portion 10 has a pair of bores, inlet bore 14 and outlet bore 16, formed therein in juxtaposition. An inlet valve 18 is set in the bore 14, and held in position by an inlet valve cage 20. A cover 22 is set against the outermost end of the cage 20 and is fastened to the cylinder head portion 10 by means of studs 24 and nuts 26 (only one of each being shown). According to the invention, in an embodiment thereof, the innermost end of the inlet cage 20 has a pin 28 fixed therein. Valve 18 comprises a seat 30 and a guard 32. The seat 30 has an annular, cage-receiving recess 34 which is so dimensioned as to accommodate the pin 28 therein.

An outlet valve 36 is set in the outlet bore 16, and is held in place by an outlet valve cage 38. Another cover 22 is set against the outermost end of the cage 38, by more studs and nuts 24 and 26 (in which, again, only one of each is shown). Valve 36, too, has a guard 32 and a seat 30.

Bore 14, inlet valve 18 and cage 20, comprise a first, mating combination of elements which exhibits a first, optimum and proper seating together of said valve 18, and cage 20 with, and within, said bore 14. Similarly, valve 36, in bore 16, with the cage 38, comprise a second, mating combination of elements which exhibits a second, optimum and proper seating together of said valve 36, and cage 38 with, and within, the bore 16.

If, inadvertently, one were to endeavor to assemble an inlet cage 20, in the inlet bore 14, with an outlet valve 36, it would be impossible to effect either of the aforesaid first and second seatings of elements. As shown in FIG. 2, just such a mismatched collection of elements is shown, and it can be seen that the pin 28, fixed in the inlet cage 20, defines of the lower end of the inlet cage 18 a configuration which will not accommodate the guard 32 and, accordingly, comprises means for preventing either one of the aforesaid seatings to occur. The guard 32 has an annular recess 40, similar to the recess 34 in the seat 30. However, it is so dimensioned as to deny an engagement with the pin 28. Pin 28, then, in this embodiment of the invention, is a means for insuring against an erroneous installation of an outlet valve 36 in the inlet bore 14. In addition, the seat 30 has a configuration which will not permit its full nesting in the lowermost portion of the bore 14.

FIG. 3 illustrates what occurs when an inlet valve 18 is emplaced in an outlet bore 16 with an outlet cage 38. The innermost end of the cage 38 has an inside diameter which is too small to accommodate the annular recess 34 of the inlet valve 18. Again, also, the guard 32 has a configuration which will not permit its full nesting in the lowermost portion of the bore 16.

Figure 4:
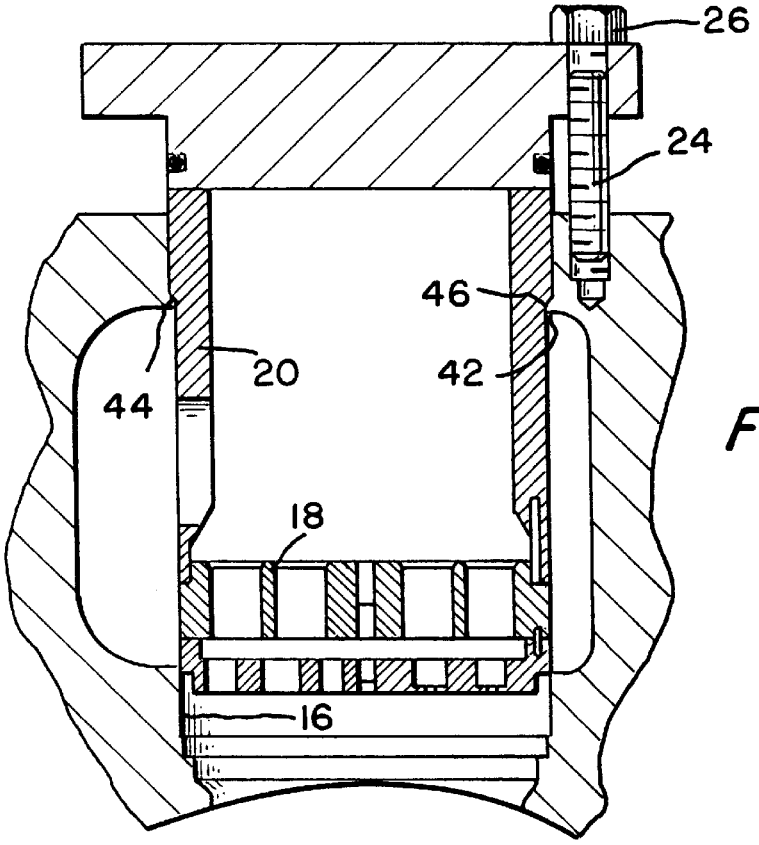
FIG. 4 shows, again in vertical cross-section, an inlet valve, with an inlet cage, and a discharge bore.

FIG. 4 depicts the mis-match of an inlet valve 18, with an inlet cage 20, being emplaced in an outlet bore 16. The outlet bore 16 has that which the inlet bore 14 hasn't, namely: an annular shelf 42 formed therein, and the same presents an impediment to the full entry of the inlet cage 20 into the bore 16. The inlet cage 20 has a shoulder 44 formed thereon which snags on the shelf 42 which is the upper, shoulder-engaging surface of a rim 46 formed in the bore 16. Consequently, the inlet valve 18 and its proper cage 20, cannot seat in the bore 16; in fact, the studs 24 can't even penetrate the cover 22 to receive the nuts 26.

As explained and illustrated, then, the invention comprises a valve polarization means in which either a cage or a bore has a configuration which, upon a substitution of one of the elements of one of the first and second mating combination of elements, namely: the bore 14, the inlet valve 18 and the cage 20, as one of the combinations, and the bore 16, the valve 36 and the cage 38 as another of the combinations, with a complementary one of the elements of the other of the other of the mating combinations, that is: valve 18 for valve 36, and valve 36 for valve 18, and cage 20 for cage 38, and cage 38 for cage 20, and bore 14 for bore 16, and bore 16 for bore 14, the polarization means is such that it prevents one of said first and second seatings, as depicted in FIG. 1, from occurring.

While I have described my invention in connection with specific embodiments thereof, it is to be clearly understood that this is done only by way of example, and not as a limitation to the scope of the invention, as set forth in the objects thereof, and in the appended claims. As for the valves 18 and 36, they are not illustrated in detail, as the component parts thereof, and the functionings, are not germane to the invention, it being sufficient to understand that valve 18 is an inlet valve, and valve 36 is an outlet valve. For exemplary purposes, the valves can be construed to comprise structures such as disclosed in U.S. Pat. No. 4,607,660, of Aug. 26, 1986, issued to Robert A. Bennitt, for a Uni-Directional-Flow, Fluid Valve Assembly; said patent, then, is incorporated herein by reference, for the background information which it can provide.

I claim:

1. Valve polarization means, for a fluid-working machine structure, comprising:

first means defining a cylinder head with valve-receiving bores formed therein;

fluid control valves; and second means defining cages for said valves; wherein a given one of said valves, a given one of said cages, and a given one of said bores, together, comprise a first, mating combination of elements which exhibits a first, optimum and proper seating together of said one valve and said one cage with, and within, said one bore;

another of said valves, another of said cages, and another of said bores, together, comprise a second, mating combination of elements which exhibits a second, optimum and proper seating together of said other valve and said other cage with, and within, said other bore; and at least one of said first and second means comprises a configuration which, upon a substitution of one of said elements of one of said first and second mating combinations with a complementary one of said elements of the other of said first and second mating combinations, that is: said given valve for said other valve, and vice versa, said given cage for said other cage, and vice versa, and said given bore for said other bore, and vice versa, comprises means for preventing one of said first and second seatings to occur.

2. Valve polarization means, for a fluid-working machine structure, according to claim 1, wherein:

said preventing means comprises an obstruction carried by one of said cages.

3. Valve polarization means, for a fluid-working machine structure, according to claim 1, wherein:

one of said cages has a valve-mating end; and said end has a pin fixed therein.

4. Valve polarization means, for a fluid-working machine structure, according to claim 1, wherein:

said one valve has an annular, cage-receiving recess ;

said recess has a given diameter; and said other cage has a valve-mating end; and said end has an inside diameter smaller than said given diameter.

5. Valve polarization means, for a fluid-working machine structure, according to claim 1, wherein:

said preventing means comprises an obstruction formed on one of said bores.

6. Valve polarization means, for a fluid-working machine structure, according to claim 1, wherein:

said other bore has an annular shelf formed therein; and said one cage has a configuration which (a) snags on said shelf, and (b) is impeded by said shelf in seating said one cage in said other bore.

7. Valve polarization means, for a fluid-working machine structure, according to claim 6, wherein:

said other bore has an inside diameter of a given dimension; and said one cage has an outside diameter of a dimension greater than said given dimension.

8. Valve polarization means, for a fluid-working machine structure, according to claim 7, wherein:

said other bore has an annular rim formed therein;

said shelf comprises a surface of said rim; and said rim has the aforesaid inside diameter of a given dimension.

9. Valve polarization means, for a fluid-working machine structure, according to claim 6, wherein:

said one cage has a shoulder formed thereon.

* * * * *